United States Patent [19]

Peltsman et al.

[11] 4,302,171

[45] Nov. 24, 1981

Best Available Copy

[54] LEVEL CONTROL FOR CERAMIC SLURRY WORKING TANK IN CERAMIC HOT MOLDING MACHINE

[76] Inventors: Michael I. Peltsman; Israel D. Peltsman, both of 1646 Hampshire Ave. South, St. Louis Park, Minn. 55426

[21] Appl. No.: 38,919

[22] Filed: May 14, 1979

[51] Int. Cl.[3] ..... B28B 00/00

[52] U.S. Cl. ..... 425/140; 425/147; 425/148; 425/150

[58] Field of Search ..... 425/140, 144, 147, 148, 425/150

[56] References Cited

U.S. PATENT DOCUMENTS 3,012,373 12/1961 Willis ..... 425/144

3,990,820 11/1976 Danguillier ..... 425/147

FOREIGN PATENT DOCUMENTS 145336 4/1962 U.S.S.R. ..... 425/148

155426 5/1963 U.S.S.R. .

159127 9/1963 U.S.S.R. .

*Primary Examiner*—John A. Parrish

*Attorney, Agent, or Firm*—Kinney, Lange, Braddock, Westman and Fairbairn

[57] ABSTRACT

A control for controlling the level in one of two tanks used in a ceramic hot molding machine which requires transfer of a ceramic slurry from one tank to the other in a continuous molding process. More particularly the present invention relates to an apparatus which automatically shuts off the transfer process when the working tank is filled a predetermined amount.

9 Claims, 3 Drawing Figures

LEVEL CONTROL FOR CERAMIC SLURRY WORKING TANK IN CERAMIC HOT MOLDING MACHINE

BACKGROUND OF THE INVENTION

1. Field of the Invention

The present invention relates to improvements in the control of transfer of material to a working tank in a ceramic molding machine.

2. Prior Art

Continuous ceramic molding machines have been advanced, and a typical machine of the type with which the present invention would be used in shown in USSR Pat. No. 159,127. In this particular patent, a molding machine is illustrated, including a multi-cavity mold which is fed from a working tank containing a ceramic slurry in an automatic process. The machine further includes a preparation tank where the solid ceramic material is preheated and mixed to form a slurry and vacuum treated. The slurry is subsequently transferred to the working tank, which also is heated has a mixer and vacuum.

In the machine described in the above identified USSR Patent, the level of slurry in the working tank was controlled through the use of a float valve. The conduit which transferred the slurry from the preparation tank to the working tank formed a passageway which permitted the slurry to flow to the working tank when vacuum was applied to the top of the working tank. When the level of the slurry in the working tank reached a predetermined height, the float valve provided a signal which caused water to cool a section of the conduit between the tanks to a level where the ceramic material in the conduit would solidify, and prevent further transfer from the preparation tank to the working tank. The floats for the valves were causing constant problems because the ceramic material in the slurry would tend to solidify on the float changing its bouyancy and therefore requiring periodic removal and cleaning.

Other types of level controls have been tried, such as X-Ray detectors, which proved to present some hazards to personnel, and photosensitive sensors, which failed to function when the ceramic slurry would solidify over the receptors or senders, and block the light.

Additionally, a second USSR Pat. No. 155,426 illustrates schematically the same type of a molding machine with which the present device is used, showing a preparation tank and a working tank, and relates in particular to valves which can be utilized for controlling fluids to effect transfer of material from the working tank to the mold and from the preparation tank to the working tank.

SUMMARY OF THE INVENTION

The present invention relates to apparatus for controlling the transfer of the ceramic slurry material or similar materials from an initial preparation tank to a working tank by providing a pivoting support assembly which will shift when the working tank has reached a predetermined weight and provide an indication of the slurry level in the tank without using sensors or other members inside such tank.

As shown, there are two tanks mounted on a common pivoting support which shifts or pivots a short distance from a rest position to control position wherein a switch is actuated to control the stopping of transfer of the slurry between the tanks. When transfer of the slurry is occurring and the working tank becomes heavier by a predetermined amount than the preparation tank, the assembly is caused to shift, and in the preferred embodiment shown the transfer of the slurry is stopped by cooling a portion of the transfer conduit to solidify the slurry in the conduit and thus to plug the conduit.

As the level in the working tank decreases through injection into the mold being used, the support assembly will shift back to its rest position. During this time when the working tank is being used in the molding process, the preparation tank will be refilled with ceramic material that is heated to form a slurry prior to the time when the working tank is empty. When the working tank is again empty, the support assembly will have moved back to its stop or rest position and then the cooled portion of the conduit is reheated to melt the chilled ceramic material and remove the block in the conduit so that a new transfer of material to the working tank can again take place.

The support assembly is counterbalanced toward its stop or rest position by a spring plunger that can be adjusted so that even if the slurries have different specific gravities, the tilting of the tank support assembly to control shutting off the transfer can be adjusted to occur when the slurry in the working tank is at the proper level.

The level control for the slurry tanks thus is not dependent upon members which are inside the working tank, where the members are susceptible to malfunction.

DESCRIPTION OF THE PREFERRED EMBODIMENT

Figure 1:
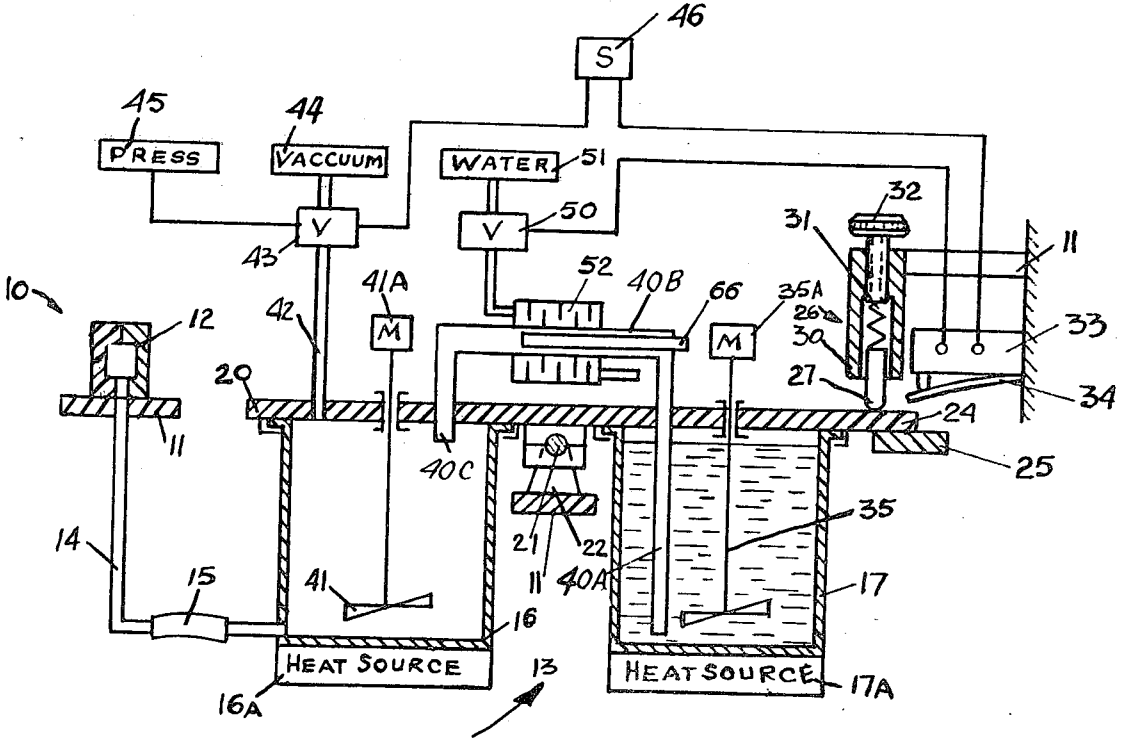
FIG. 1 is a part schematic sectional view of a typical hot molding machine including a preparation tank and a work tank mounted on a support made for controlling the level of the slurry in the working tank in accordance with the present invention.

A ceramic hot molding machine is illustrated schematically and generally at 10 and includes a frame 11 that is shown in segments for purposes of illustration. The machine is similar to that shown in the previously mentioned USSR Patents. The machine provides for a continuous ceramic hot molding process by using a mold shown schematically at 12 filled from a source of supply comprising a tank assembly illustrated generally at 13. The mold 12 can be any type of mold desired, such as a multi-cavity mold which is charged through a supply conduit 14 having a flexible connection portion 15 leading from the outlet pipe of a working tank 16 forming part of the tank assembly 13.

The working tank 16 contains a heated ceramic slurry in condition for molding, and the tank assembly 13 further includes a preparation tank 17. The tanks 16 and 17 are both supported on a tank support table or frame 20 that, as shown, is pivotally mounted on a substantially horizontal shaft 21 that is supported on supports 22 attached to the frame 11. The shaft 21 is positioned near a balance point of the support table or frame 20 and the support table or frame 20 has a lug or portion 24 at one end that will rest against a stop member 25 attached to the frame 11. The support table or frame 20 is urged about the axis of shaft 21 against stop 25 through the force of a counterbalance or loading assembly 26. The loading assembly includes a sleeve 30 which has a plunger 27 slidably mounted therein. The end of the plunger extends out of the sleeve 30 and the outer end of the plunger engages the upper surface of the support table. A spring 31 is mounted within the sleeve 30 to urge the plunger outwardly. The spring force on plunger 27 is adjustable through the use of a hand wheel 32 that controls a screw which is threaded to the end of sleeve 30. The sleeve 30 is supported with respect to the frame 11 in any desired manner. The pivot supports for the support table or frame 20 may be any desired arrangement, but shaft 21 is shown for convenience.

A microswitch 33 is provided adjacent the lug or portion 24, and has an actuating finger 34 that is aligned with the lug 24 for actuation, as will be explained.

In the ceramic hot molding process, the preparation tank 17 is used for receiving ceramic material in solid form, and within the tank 17 the solid material is heated from a heat source 17A and mixed with a mixer blade shown schematically at 35 which may be driven by a motor 35A until it becomes a suitable slurry. The heating process takes some time, and hot molding of work pieces with the mold 12 may continue while the material is heated in tank 17 using the ceramic slurry material that is within the working tank 16. The working tank 16 also has a heat source 16A to keep the ceramic material at a temperature in the range of 50° C. to 100° C. at which temperature the material is a slurry.

It can be also seen that the tanks 16 and 17 are attached to the underside of the support table or frame 20 through the use of suitable rim clamps or similar fasteners so that the tanks themselves can be made airtight.

A transfer conduit 40 extends between the preparation tank and the work tank and as shown, has a section 40A in the preparation tank that is open near the bottom of the tank 17. The conduit includes a second horizontal section 40B that is positioned above the support table or frame 20, and a third feed section 40C that is open to the interior of the working tank 16. It should also be noted that the tank 16 may have a mixer blade 41 that is driven by a motor 41A to keep the slurry within the working tank 16 properly mixed.

Further, the working tank 16 is connected through a suitable conduit 42 to a valve 43, which connects the interior of working tank 16 selectively to a vacuum source 44 or to a pressure source 45. To transfer material from tank 17 to the tank 16, the tank 16 is placed under a vacuum. The conduit 40 is unobstructed when transfer of the slurry is to take place. A suitable switch 46 is operated (manually or automatically) to close a circuit and energize valve 43 to subject tank 16 to a vacuum. This then will cause the slurry material in tank 17, assuming that it has been heated to a desired level, and is under atmospheric pressure, to be forced by the atmospheric pressure through the conduit 40 and discharged into the tank 16.

Figure 2:
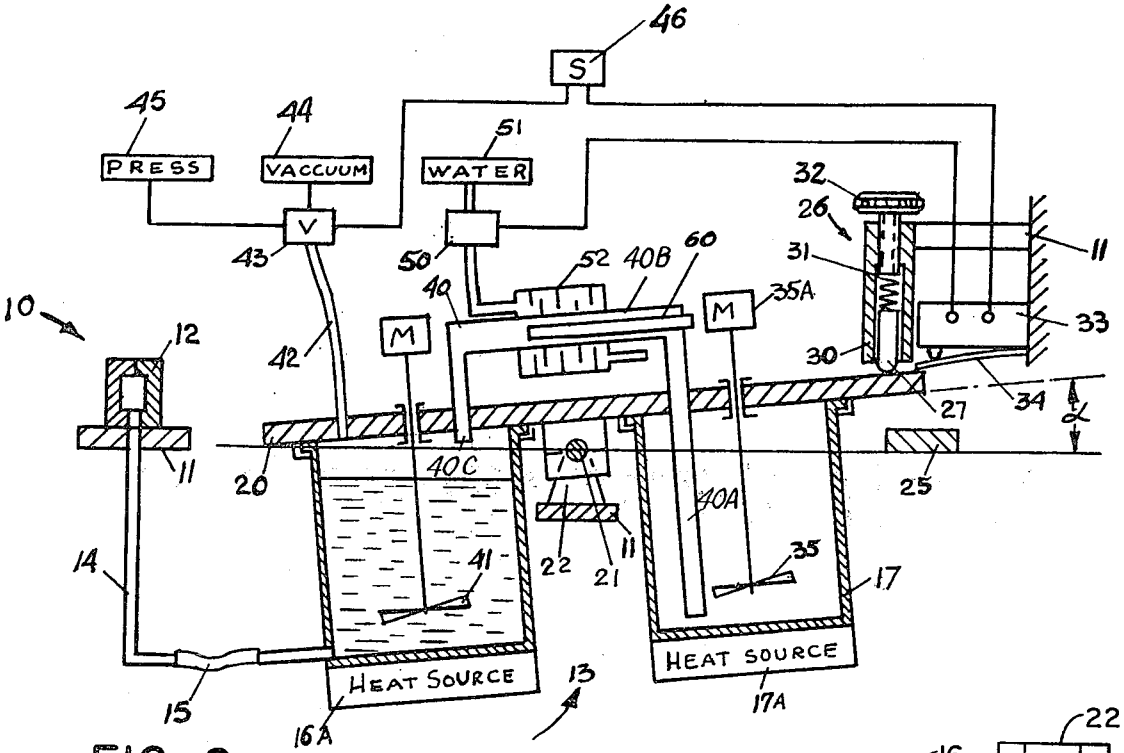
FIG. 2 is a view substantially similar to FIG. 1 showing the tank support in a position wherein the support has tilted to signal that transfer of material to the working tank should stop.
Figure 3:
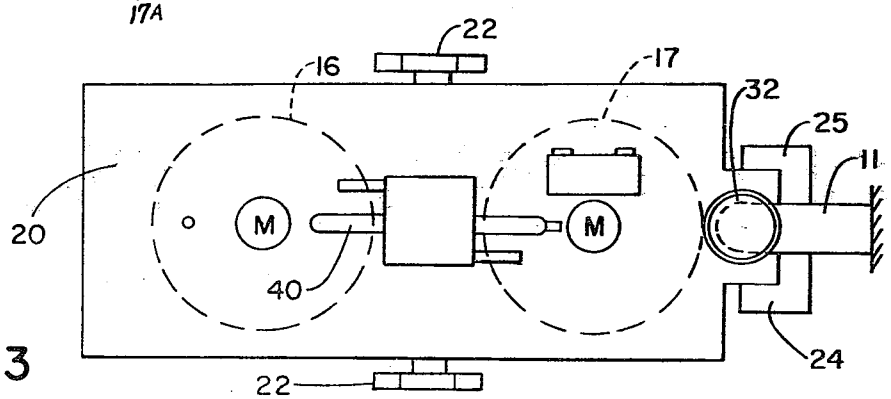
FIG. 3 is a schematic top plan view of the support assembly for the working and preparation tanks of the present invention.

As was explained, the plunger 27 tends to keep the support table or frame 20 against the stop 25. However, as the slurry is withdrawn from the tank 17 and discharged into the working tank 16, the weight of the working tank will create a moment about the pivot shaft 21 tending to lift the lug 24 away from the stop 25. This lifting action will be resisted by the plunger 27 and the spring load (which can be adjusted), but when a desired amount of material has been transferred to the working tank 16, the support table 20 will pivot about the shaft 21 and will compress the spring 31. When the support table has shifted an angular amount shown at $\alpha$ in FIG. 2 the microswitch 33 will be actuated by the actuator 34. The microswitch signal may be used to open the circuit to valve 43 to release the vacuum on the tank 16 and at the same time the microswitch may open a valve 50 which provides for a flow of water from a source 51 to a jacket 52 that surrounds the portion 40B of the conduit 40. The water in the jacket will cool the ceramic slurry that is within this portion 40B and solidify it thereby plugging the conduit 40 and preventing further transfer of the ceramic slurry to the working tank 16. The plug of material thus acts as a valve to control flow of the slurry. At this time suitable controls can be utilized to continue to apply a vacuum from the source 44 to the ceramic material in tank 16 until such time as all dissolved air bubbles have been removed. The pressure source 45 can be connected to the tank 16 through the valve 43 (by using manual operation or automatic operation) to create a pressure within the tank 16. Because the cooled ceramic material has formed a plug in the conduit 40, the pressure in tank 16 will force material through conduit 14 and out into the mold 12, which will continue the molding process in the normal manner. Note that flexible conduit section 15 permits the tank 16 to move slightly. Also, the actual movement of lug 24 will be very small, on the order of 2–3 millimeters, although it is illustrated as being substantial.

The slurry in the tank 16 will remain heated and in the slurry state. The support table or frame will again tilt back against the stop 25 when the spring force on plunger 27 is great enough in relation to the ratio of weights in tanks 16 and 17. The water to jacket 52 will be permitted to flow to keep the plug in place in conduit 40 until an additional or new transfer of material from tank 17 to tank 16 is desired. When this is desired, the water will be shut off and section 40B of the conduit will be heated through the use of a suitable heater indicated at 60, to heat the ceramic plug within the conduit 40 causing it to return to its slurry state.

Then, the vacuum source 44 will again be connected through valve 43 to the tank 16 and the transfer of the slurry can again take place. The valve 50 would be deenergized to stop the water flow in any suitable manner.

It can therefore be seen that the ceramic hot molding machine 10, illustrated schematically, has a unique level control for controlling the level of raw material (slurry) in the working tank 16 after transferring the slurry from the preparation tank 17 has occurred. This provides a control which does not have to be in contact with the slurry, nor does it have to be within the tank 16 to obtain the level. If different materials having different specific gravities are utilized, the adjustment can be accommodated, by hand wheel 32, to maintain the level at which the frame or table 20 will shift to shut off the process regardless of a different weight of material in tank 16.

The flow control for the slurry may be any suitable valve as well as the plug that is formed in the transfer conduit. Also the balancing, or tilting support for the tanks can be constructed in forms other than a table.

A specific embodiment has been described, but it is to be understood that variations in construction of various components can be made without departing from the scope of the attached claims.

What is claimed is:

1. In a ceramic slurry hot molding machine having a working tank and a preparation tank for holding the slurry, and wherein transfer of material from said preparation tank to said working tank is required in the process, the improvement comprising an apparatus for determining when a desired amount of slurry has been transferred to said working tank, including a tank support for mounting said working tank, means to pivotally mount said tank support for pivotal movement from a first stopped position to a second position, means to counterbalance said working tank about its pivot to retain the tank support in said first stopped position until the material in said working tank reaches a desired level, and means to sense movement of said tank support to said second position.

2. The improvement as specified in claim 1 wherein said means to counterbalance includes said preparation tank mounted on an opposite side of the pivot axis of said means to pivotally mount from the working tank.

3. The improvement as specified in claim 1 wherein said means to counterbalance further comprises spring means urging said tank support toward said first position.

4. The improvement as specified in claim 3 wherein said spring means is adjustable.

5. The improvement as specified in claim 1 wherein said means to sense includes control means to stop the transfer of the slurry from said preparation tank to said working tank when the tank support has moved to its second position.

6. The improvement as specified in claim 1 wherein said tank support comprises a common support for both said working tank and said preparation tank, said means to pivotally mount being positioned at a location between said tanks whereby differentials in weight of said preparation and working tanks will cause said tank support to pivot to said second position.

7. An apparatus for determing the level of a slurry material in a tank, said apparatus comprising a balance assembly, a tank for holding said nonsolid material mounted on said balance assembly, means to detect shifting of said balance assembly from a first position when the level of material in said tank exceeds a desired amount, and control means responsive to the means to detect to stop transfer of material into said tank when the means to detect has indicated the tank has moved from its first position.

8. The apparatus as specified in claim 7 wherein said balance assembly is a pivotally mounted support, and wherein the apparatus comprises two tanks, one of which is a preparation tank, and the other of which is a working tank, and means to transfer nonsolid material from said preparation tank to said working tank until the means to detect indicates that the material in said working tank has exceeded the desired amount.

9. The apparatus of claim 8 wherein said means to transfer includes a conduit for carrying hot ceramic slurry from the preparation tank to said working tank, and said control means includes a water jacket surrounding a portion of said conduit and means to control flow of water to the water jacket to cool and solidify hot ceramic material in said conduit.

* * * * *

UNITED STATES PATENT OFFICE

CERTIFICATE OF CORRECTION

Patent No. 4,302,171 Dated November 24, 1981

Inventor(s) Michael I. Peltsman et al.

It is certified that error appears in the above-identified patent and that said Letters Patent are hereby corrected as shown below:

Column 6, line 10, (Claim 7, line 1) "determing" should be --determining--; Column 6, line 12, (Claim 7, line 3) "nonsolid" should be --slurry--; Column 6, line 24, (Claim 8, line 5) "nonsolid" should be --slurry--.

Signed and Sealed this

*Ninth* Day of *March 1982*

[SEAL]

*Attest:*

GERALD J. MOSSINGHOFF

*Attesting Officer*

*Commissioner of Patents and Trademarks*